United States Patent [19]

Sarcia

[11] 4,372,128

[45] Feb. 8, 1983

[54] IN-LINE CRYOGENIC REFRIGERATION APPARATUS OPERATING ON THE STIRLING CYCLE

[75] Inventor: Domenico S. Sarcia, Carlisle, Mass.

[73] Assignee: Oerlikon-Buhrle U.S.A. Inc., New York, N.Y.

[21] Appl. No.: 316,995

[22] Filed: Nov. 2, 1981

[51] Int. Cl.[3] ..... F25B 9/00

[52] U.S. Cl. ..... 62/6; 137/625.37

[58] Field of Search ..... 62/6; 137/625.37

[56] References Cited

U.S. PATENT DOCUMENTS

| | | | |
|---|---|---|---|
| 2,906,101 | 9/1959 | McMahon et al. | 62/6 |
| 2,966,035 | 12/1960 | Gifford | 62/6 |
| 3,119,237 | 1/1964 | Gifford | 62/6 |
| 3,188,821 | 6/1965 | Chellis | 62/6 |
| 3,218,815 | 11/1965 | Chellis et al. | 62/6 |
| 3,421,331 | 1/1969 | Webb | 62/6 |
| 3,600,903 | 8/1971 | Chellis | 62/6 |
| 3,609,982 | 10/1971 | O'Neil et al. | 62/6 |
| 3,620,029 | 11/1971 | Lonesworth | 62/6 |
| 3,733,837 | 5/1973 | Lobb | 62/6 |
| 3,788,088 | 1/1974 | Dehne | 62/6 |
| 3,853,146 | 12/1974 | Blair | 137/625.37 |
| 4,108,210 | 8/1978 | Luthe et al. | 137/625.37 |

*Primary Examiner*—Ronald C. Capossela

*Attorney, Agent, or Firm*—Schiller & Pandiscio

[57] ABSTRACT

Cryogenic refrigeration apparatus characterized as an in-line Stirling engine wherein the piston and displacer are driven by means mechanically linking them to move in phase along a common axis. The flow of fluid between the compressor and expander is controlled by fluid flow control means, actuated by the motion of the driving means, which makes possible the achievement of essentially constant volume heat removal.

11 Claims, 5 Drawing Figures

IN-LINE CRYOGENIC REFRIGERATION APPARATUS OPERATING ON THE STIRLING CYCLE

Figure 1:
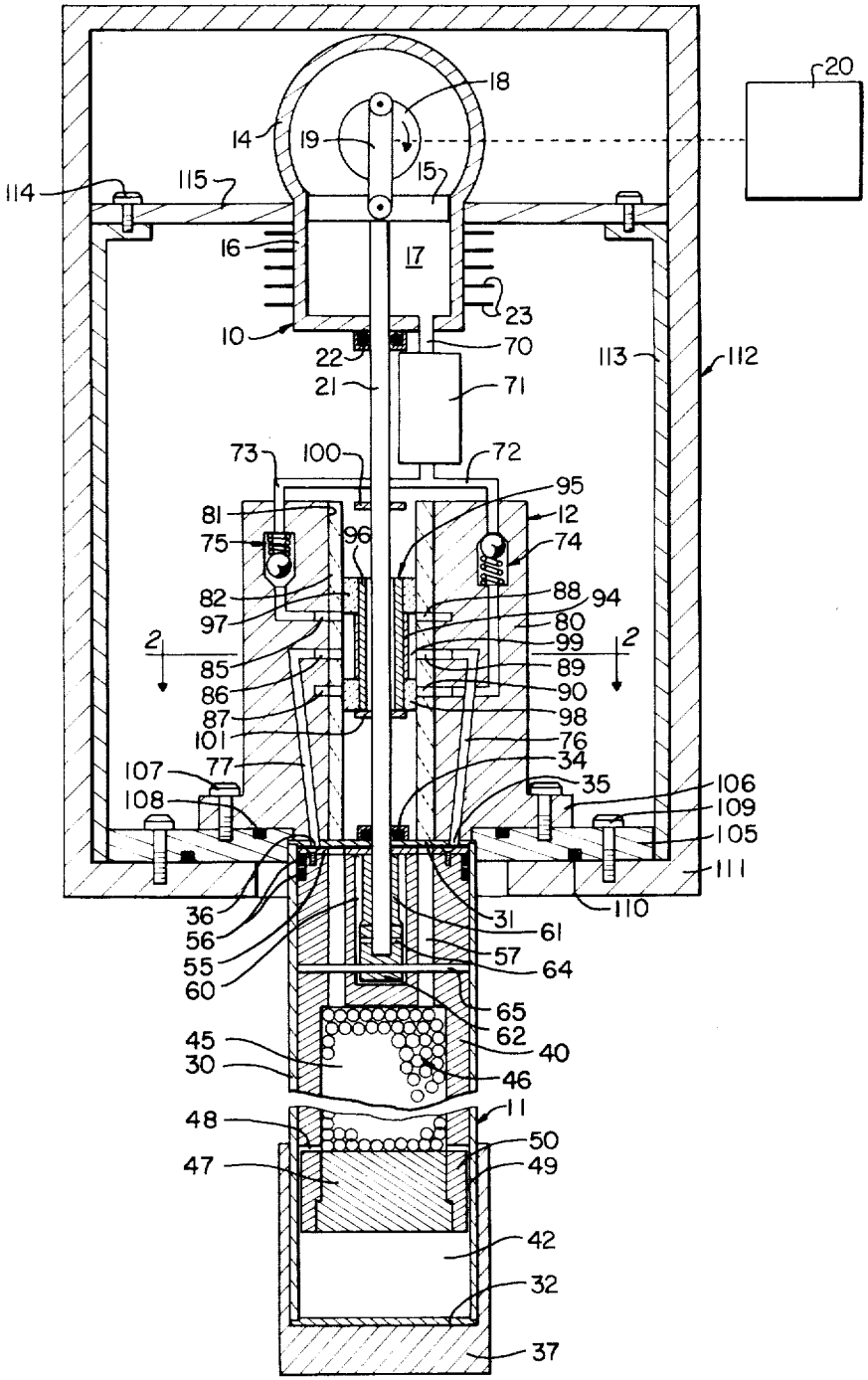

This invention relates to cryogenic refrigerators for delivering refrigeration to an external load, and more particularly to improved refrigerators operating on the so-called Stirling cycle.

In the Stirling cycle used to develop cryogenic temperatures, a quantity of refrigerant, normally helium, is compressed, cooled to remove heat of compression, taken through a regenerator in which heat from the gas is absorbed and stored, expanded to its lowest temperature to provide refrigeration and then recycled through the regenerator and returned to be recompressed. To attain this cycle, which results in an efficient P-V diagram, the motions of the piston in the compressor and the displacer in the expander must be so controlled as to achieve essentially constant volume heat removal. This in turn has required in prior art devices that means be provided to move the piston to effect some 75% of the compression stroke while maintaining the displacer essentially stationary and subsequently moving the displacer through some 75% of its expansion cooling stroke while maintaining the piston essentially stationary. By operating the piston and displacer 90° out of phase it has been possible to attain the necessary control over the motion of the piston and displacer. Several different mechanisms are presently available to accomplish this.

The first and most widely used prior art mechanism employs a secondary crank and uses a V-type crankcase, one cylinder serving as the compressor and the other as the expander with a regenerator connecting them. Another mechanism provides a single housing for the compression piston and the expander displacer, the piston and displacer being reciprocated separately in line using concentric shafts (e.g. the displacer shaft within the compressor shaft) mechanically linked to achieve the desired out-of-phase motions of the piston and displacer. Although this prior art in-line configuration has some advantages, it presents serious additional sealing problems. A third Stirling design provides the compressor with its piston, cylinder and crank mechanism as a totally separate unit from the expander with its displacer which incorporates the regenerator. The compressor and expander are connected by a fluid line and displacer movement is effected solely by pulsing pressurized gas into the expander.

Although the Stirling cycle for cryogenic refrigeration possesses thermodynamic advantages, such advantages have been realizable only through mechanisms and/or mechanical configurations which present such problems as the need for a secondary crank, the necessity to provide added seals, the lack of precise control over the displacer motion or a combination of several of these drawbacks. From this it will be seen that it would be desirable to be able to provide an inline Stirling refrigerator which requires but a single crank, minimizes sealing problems and presents a compact configuration.

It is therefore a primary object of this invention to provide an improved refrigeration apparatus, operating on the Stirling cycle, capable of delivering refrigeration to an external load. It is another object to provide such a refrigeration apparatus which is of the in-line type but does not require a secondary crank or present added sealing problems. It is yet another object to provide an in-line Stirling cycle refrigerator which attains an efficient thermodynamic cycle, uses a single rotating shaft as the drive mechanism and has incorporated in it a reliable valving mechanism to control the flow of fluid making it possible to achieve the required essentially constant-volume heat removal while driving the piston and displacer with a single shaft. Other objects of the invention will in part be obvious and will in part be apparent hereinafter.

The invention accordingly comprises the features of construction, combinations of elements, and arrangement of parts which will be exemplified in the constructions hereinafter set forth, and the scope of the invention will be indicated in the claims.

Accordingly to one aspect of this invention there is provided a cryogenic apparatus for delivering refrigeration to an external load, comprising in combination compressor means having a rotary-driven reciprocating piston; expander means having displacer means capable of reciprocal motion to define within the expander means a warm fluid chamber and a cold fluid chamber, the chambers being of variable complementary volumes; thermal storage means providing fluid communication between the fluid chambers; driving means mechanically linking the piston and the displacer means to move them in phase along a common axis; fluid flow passage means connecting the compressor means and the expander means; and fluid flow control means associated with the fluid flow passage means and arranged so as to (1) cut-off fluid flow from the compressor means to the expander means throughout a major part of the compression stroke of the compressor; (2) permit flow of high-pressure fluid from the compressor means to the warm fluid chamber during the completion of the compression stroke; (3) cut off fluid flow from the expander means to the compressor means throughout a major part of the transference of fluid from the warm chamber to the cold chamber through the regenerator; and (4) then permit flow of fluid from the expander means to the compressor means expanding the fluid and developing refrigeration within the cold fluid chamber.

In a preferred arrangement the driving means is a single shaft having affixed thereto spaced annular actuating rings and the fluid flow control means comprise (a) a valve body with an internal bore and having first, second and third spaced apart annular grooves in the wall defining the bore; (b) a valve casing lining the wall of the bore coaxial with the shaft and having first, second and third sets of a plurality of radial fluid passages communicating with the first, second and third annular grooves, respectively; and (c) a valve member slidable within said valve casing under the force of said actuating rings. The valve member comprises (1) a sleeve encircling the shaft and spaced therefrom, and (2) two spaced apart rings affixed to the sleeve, making sliding contact with the valve casing and defining therebetween an annular fluid manifold, the length of which is chosen such that it provides fluid communication either exclusively between the first and second annular grooves through the first and second radial passages or exclusively between the second and third annular grooves through the second and third radial passages. In this arrangement the fluid flow passage means comprises a low-pressure fluid line communicating with the first annular groove, a high-pressure fluid line communicating with the third annular groove and variable-pressure lines communicating with the second annular groove and leading into the expander means.

Figure 2:
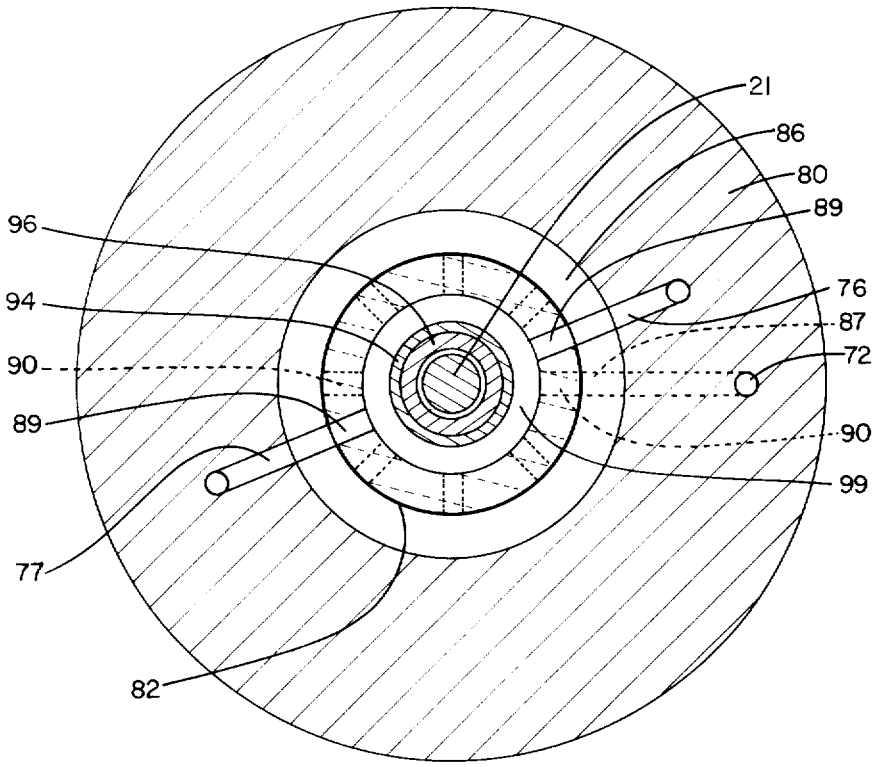
Figure 3:
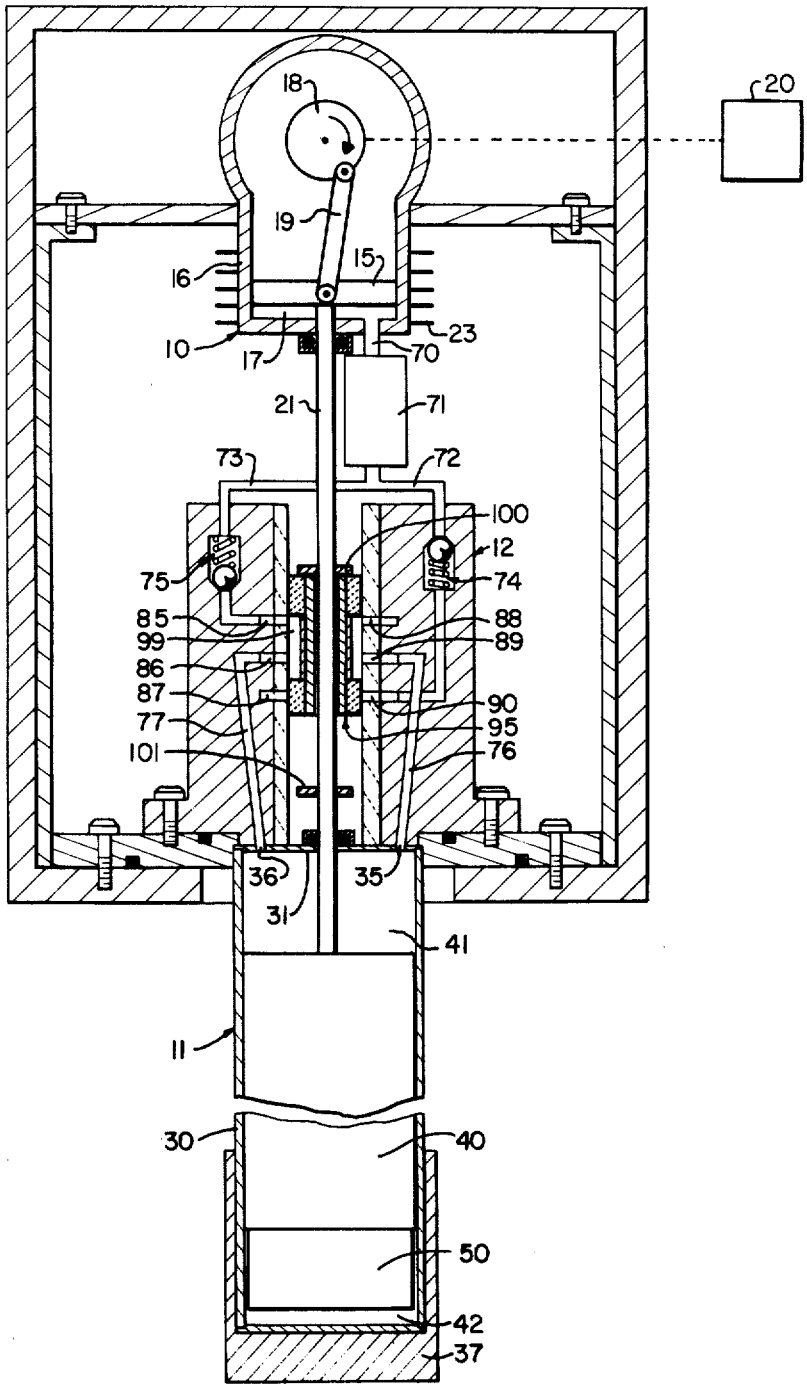
Figure 4:
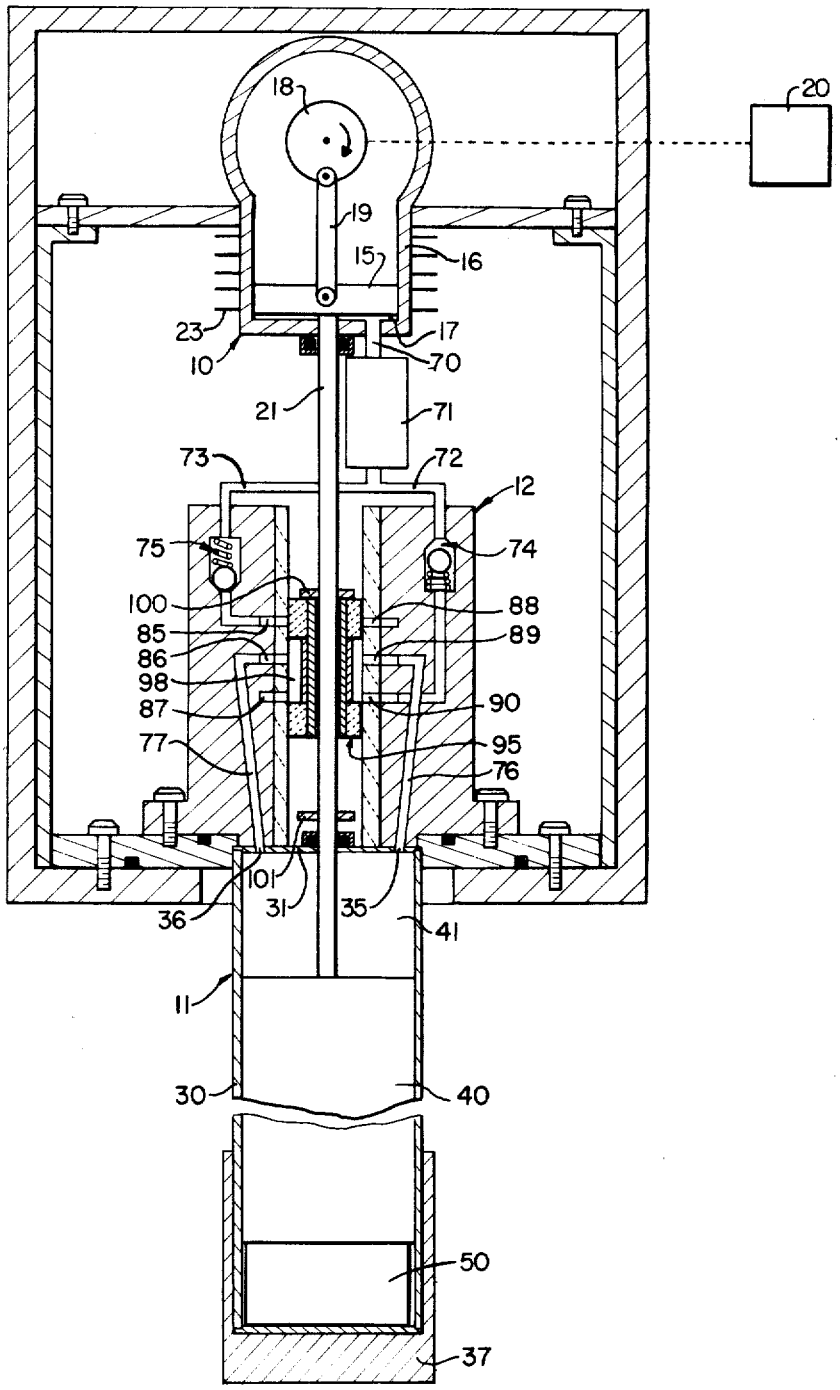
Figure 5:
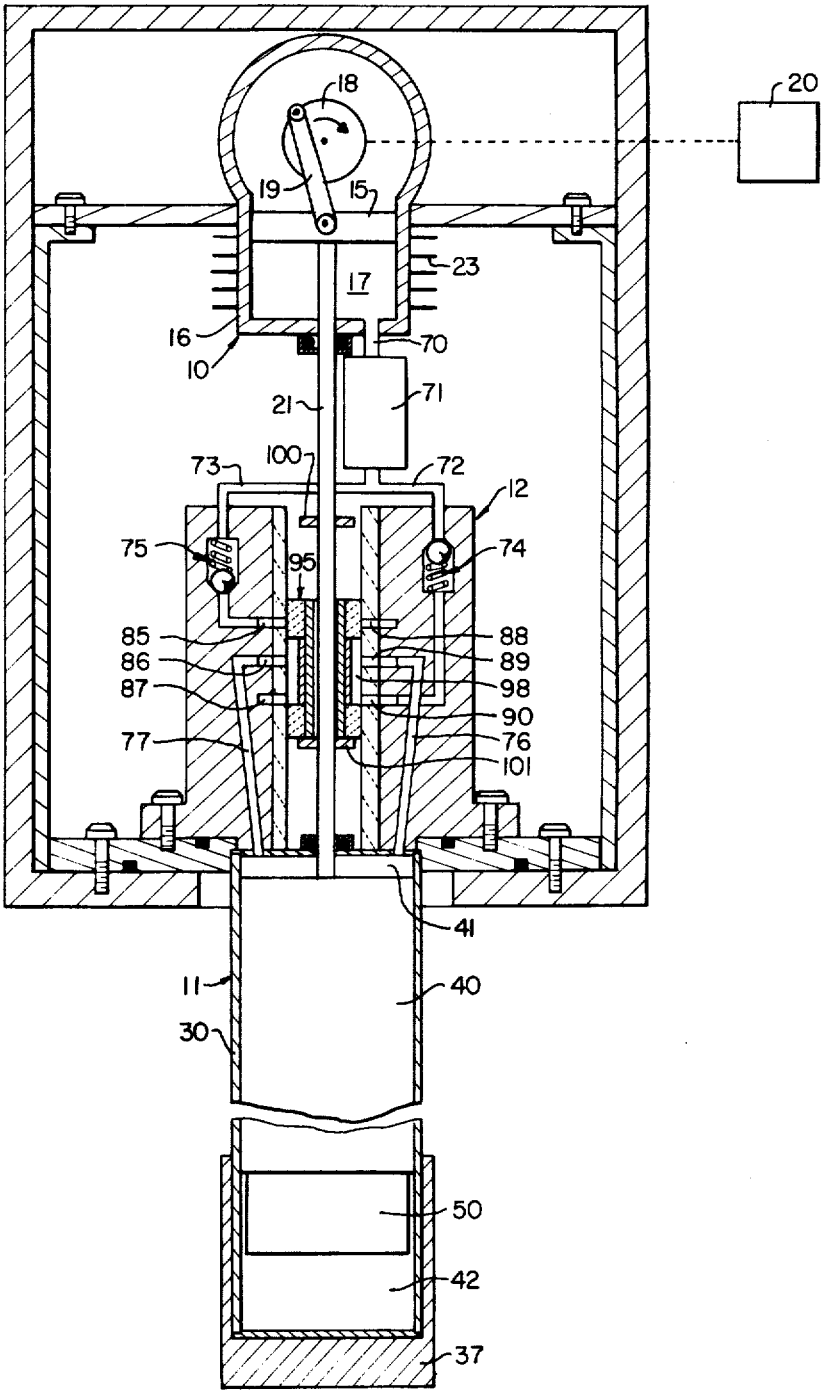

For a fuller understanding of the nature and objects of the invention, reference should be had to the following detailed description taken in connection with the accompanying drawings in which FIG. 1 is a longitudinal cross-section of one embodiment of the refrigeration apparatus of this invention illustrating the positions of the piston and displacer at the end of the exhaust portion of the cycle;

FIG. 2 is a transverse cross-section of the fluid flow control valve interposed between the expander and compressor taken through plane 2—2 of FIG. 1; and FIGS. 3-5 are longitudinal cross-sections of the embodiment of FIG. 1 illustrating, along with FIG. 1, the movements of the displacer and piston and the attainment of the required fluid flow control throughout a complete cycle.

It will be appreciated that the drawings illustrate but one possible orientation of the refrigerator and that such terms as "upper" and "lower" chambers, "top" dead center (TDC) and "bottom" dead center (BDC), "high" and "low" pressure and "warm" and "cold" fluid are all relative. Along with the particular apparatus orientation shown, these terms are used in the following detailed description for convenience, as will be apparent to those skilled in the art.

The cryogenic refrigerator of this invention may be described in detail with reference to FIGS. 1 and 2 in which the same reference numerals are used to refer to the same components.

As will be seen from FIG. 1, the refrigeration apparatus of this invention comprises a compressor 10 and an expander 11, with a fluid flow control valve 12 interposed in the fluid flow path connecting them. Compressor 10, in keeping with known practice, is comprised of a housing 14 and has a piston 15 which undergoes reciprocal motion in the cylindrical section 16 of compressor 10 to define a compression chamber 17 of variable volume. Piston 15 is connected by a crank 18, 19 to the drive shaft (shown as a dotted line) of a rotary drive means such as motor 20 which imparts the desired motion to the piston. Main shaft 21 is affixed to piston 15 and mechanically links it to expander 11 as detailed below. Suitable sealing means (diagrammatically represented as a sealing ring 22) are provided for shaft 21; and in keeping with well recognized compressor design, heat transfer means such as fins 23 are provided on the external surface of cylindrical section 16 to remove at least a portion of the heat of compression of the compressor fluid delivered from compressor 10.

The embodiment of expander 11 illustrated in cross sectional detail in FIG. 1 comprises a closed cylindrical housing 30, typically made of stainless steel, having a top plate 31 and bottom plate 32. Top plate 31 has a central opening which allows the passage of main shaft 21 therethrough and fluid sealing means such as illustrated by sealing ring 34 are provided for shaft 21. Fluid ports 35 and 36 which are alternately connected to the high-pressure and low-pressure fluid lines are also provided in top plate 31. Surrounding the lower portion of cylindrical housing 30 and in thermal contact with its external surface as well as with the external surface of bottom plate 32 is a heat station 37 formed of a material, e.g., copper or silver, having high heat conductivity at cryogenic temperatures. The refrigeration load, e.g., a detector, a cryopump or sample under observation, is thermally connected to heat station 37 when the refrigerator is in use.

Within expander 11 is the displacer 40 which in its reciprocal motion defines within the expander an upper chamber 41 (FIG. 3) and lower chamber 42 of complementary variable volumes. It will be appreciated that the displacer may take a number of different forms and may be staged to provide fluid chambers of volumes and temperatures intermediate between the two chambers 41 and 42 shown. Such configurations of the expander housing and displacer are well known and are to be considered within the scope of this invention.

Within displacer 40 is a chamber 45 filled with a high heat capacity material, e.g, screening or lead balls, to provide a thermal regenerator 46. The lower end of chamber 45 is closed off by a plug 47 which is preferably formed of a high thermal conductivity material. At the cold, lower end of regenerator 46 a plurality of radial fluid passages 48 provide fluid communication between regenerator 46 and a narrow annular fluid passage 49 defined between the internal wall of expander cylindrical housing 30 and the external surface of the lower reduced-diameter section 50 of displacer 40. Annular fluid passage 49 is, in turn, in fluid communication with the lower cold chamber 42.

The upper end of displacer 40 is closed off by a perforated annular plate 55 attached to the displacer and serving as a retainer for displacer seal 56. Plate 55, which may for convenience be formed of two semicircular sections, has apertures aligned with a plurality of fluid passages 57 extending to regenerator 46 to provide fluid communication between upper, warmer fluid chamber 41 and the regenerator, thus completing the fluid flow path between chambers 41 and 42. In keeping the prior art construction, the regenerator may be located externally of the expander, in which case the fluid flow path between chambers 41 and 42 will comprise an external fluid line incorporating the regenerator.

Cut into the upper end of the displacer body is a bore 60 into which a shaft sleeve 61, affixed to the underside of top plate 55, extends to provide support for shaft 21. A plug 62 is affixed to shaft 21 by a roll pin 64. Plug 62 is, in turn, connected to the displacer body through a roll pin 65, thus locking main shaft 21 to displacer 40 (for convenience of illustration, roll pin 65 and passages 57 are shown in the cross-section of FIG. 1. It will, however, be appreciated that roll pin 65 and fluid passages 57 must lie in different planes).

Providing fluid communication between compression chamber 17 and the upper warmer displacer chamber 41 (shown as a distinct chamber in FIG. 3) is a fluid flow path having fluid flow control valve 12. Beginning with compressor 10, the primary fluid flow path can be seen to comprise a fluid conduit 70 having a heat exchanger 71 and branching into a high-pressure line 72 and a low-pressure line 73. One-way, flow-control check valves 74 and 75 are located in high-pressure line 72 and low pressure line 73, respectively, and these lines lead into the fluid flow control valve 12. Also connected to valve 12 are fluid conduits 76 and 77, which communicate with chamber 41 through fluid ports 35 and 36 in plate 31. By controlling fluid communication between high-pressure conduit 72 and conduits 76 and 77 on the one hand and between low-pressure conduit 73 and conduits 76 and 77 on the other hand, fluid flow control valve 12, which is actuated by the reciprocating motion of main shaft 21, makes it possible to control the flow of fluid in accordance with the relative motions of piston 15 and displacer 40 to achieve the desired Stirling cycle operation.

Fluid flow valve 12, as shown in FIGS. 1 and 2, comprises a valve body 80, running through which are conduits 72, 73, 76 and 77 and in which check valves 74 and 75 may be located. It is also within the scope of this invention to locate essentially all or a portion of any one or all of these fluid conduits and check valve means external of valve body 80. Valve body 80 has an axially aligned bore 81, running throughout its length, which is lined with a valve casing 82 making a tight fit with the bore wall. Cut into the internal surface defining bore 81 are three axially spaced, circumferentially extending grooves 85, 86 and 87; and cut through the wall of casing 82 are sets of radial ports 88, 89 and 90, each set being comprised of a plurality of equally spaced ports. The radial ports 88 are in line and in fluid communication with groove 85, ports 89 are in line and in fluid communication with groove 86, and ports 90 are in line and in fluid communication with groove 87. High-pressure fluid line 72 communicates with groove 87 and low-pressure fluid line with groove 85, while the two fluid lines 76 and 77 leading to expander chamber 41 are in fluid communication with the central groove 86. In the drawing of FIG. 1, the actual positions of fluid lines 76 and 77 have been shifted for purposes of illustration. It will be apparent that these lines cannot intersect line 72. Reference should therefore be had to the transverse cross section of FIG. 2 wherein the respective positioning of these fluid lines is clarified.

A valve member, generally indicated by the reference numeral 95, and slidably movable within valve casing 82, is comprised of a sleeve 96 sized to permit movement of main shaft 21 therethrough without contact, and spaced rings 97 and 98 which are attached to sleeve 96 and are separated by a metal spacer sleeve 94. Rings 97 and 98 define between them an annular fluid manifold 99 which is alternately in fluid communication with high-pressure fluid line 72 and low-pressure fluid line 73 depending upon the movement of main shaft 21 to which are attached an upper valve actuating ring 100 and a lower valve actuating ring 101. The necessary sealing between the inner wall of valve casing 82 and the external wall of valve rings 97 and 98 may be attained either through the use of appropriate materials for the casing and rings such that their surfaces are of a character to make sealing contact or through the use of O-ring seals (not shown) appropriately spaced along the length of valve member 95. Inasmuch as valve member 95 must remain stationary throughout a portion of each cycle, it must also make a friction fit with valve casing 82. The motion imparted to valve member 95 and the manner in which it controls fluid flow will be described below in the detailed discussion of the operation of the refrigerator with reference to FIGS. 1–5.

FIG. 1 illustrates one exemplary means for mounting the refrigerator of this invention. It is, of course, to be understood that the mounting shown is not meant to be limiting. The expander 11 is affixed by any suitable means to a mounting ring 105 on which is also mounted valve body 80 through a flange 106 by means of a plurality of screws 107 using an O-ring 108 for sealing. The fluid flow valve 12 is positioned to be coaxial with shaft 21 and to align fluid lines 76 and 77 with fluid ports 35 and 36. Mounting ring 105 is affixed by screws 109, using an O-ring seal 110, to the bottom 111 of a housing, generally shown by the reference numeral 112. Within housing 112 is provided a suitable support member 113 to which is affixed, through screws 114, a mounting ring 115 for compressor 10. In using the refrigerator, the expander will normally be contained within a suitably thermally insulated device (e.g., an evacuated enclosure with radiation shields and the like) adapted to contain the refrigeration load. Such a device will, of course, vary greatly depending upon the nature of the load, and since it is not part of the invention, it is not illustrated.

The operation of the refrigerator on the Stirling cycle is illustrated in FIGS. 1–5. In FIG. 1 displacer 40 and piston 15 are in their top dead center (TDC) position, having attained this position at the completion of the exhausting of the expanded low-pressure fluid from the expander into the compressor. In reaching this position, valve actuating ring 101 has been in contact with and in control of valve member 95. It will be seen that the low-pressure fluid has been able to flow into compression chamber 17 inasmuch as valve member 95 is so positioned as to provide fluid communication between lines 77 and 76 and compressing chamber 17 by way of circumferential groove 86, radial passages 89, annular manifold 99, radial passages 88, circumferential groove 85, check valve 75, low-pressure line 73 and fluid line 70. Valve 75 closes automatically as the pressure of the fluid on the displacer side of the valve drops below a threshold level.

It will be seen from FIG. 3 that with the downward movement of shaft 21, valve actuating ring 100 moves into position to actuate valve member 95. Contact of ring 100 with the valve member takes place at that point in the cycle when piston 15 and displacer 40 have traveled some three-quarters of the distance required to reach bottom dead center (BDC), that is, when the crank has moved some 135° from TDC. Displacer 40 moves downwardly, transferring whatever low-pressure cold fluid remains in chamber 42 by way of regenerator 46 into chamber 41. Although the fluid lines from chamber 41 are open to low-pressure check valve 75, the pressure of the fluid on the displacer side of the valve is insufficient to open it, and high-pressure check valve 74 is designed to remain closed up to this point in the cycle. In summary then, between the TDC position of FIG. 1 and the position of FIG. 3, the fluid flow control valve has cut off fluid flow from the compressor to the expander throughout a major portion, e.g., about 75% of the compression stroke of the compressor.

As will be apparent from FIGS. 3 and 4, once actuating ring 100 makes contact with valve member 95 it is quickly moved downwardly to effect fluid communication between high-pressure line 72 and annular manifold 99. Simultaneously, the compressed fluid delivered from compressor 10 is at sufficient pressure to actuate check valve 74. With the opening of ports 90 and the introduction of high-pressure fluid into manifold 99, high-pressure fluid is delivered through fluid lines 76 and 77 into upper warm chamber 41 of expander 11. With the upper actuating ring 100 controlling valve member 95, piston 15 and displacer 40 reach BDC, which means that chamber 41 with warm high-pressure fluid is at a maximum volume in preparation for the transfer, with concomitant cooling, of the high-pressure fluid to chamber 42. Thus, the fluid flow control valve 12, subsequent to the attainment of the major part of the compression stroke permits the high-pressure fluid from the compressor to flow into the expander during the completion of the compressor stroke.

Once the rotary motion of the drive means begins the upward motion of shaft 21, displacer 40 moves upwardly to force the warm fluid from chamber 41 through regenerator 46 into cold chamber 42, the fluid being initially cooled by giving up heat in the regenerator. Since with the attainment of the BDC position, essentially all of the fluid is discharged from compressor 10, high-pressure check valve 74 can no longer be kept open and fluid flow is cut off to the compressor. It will be noted that in its position shown in FIG. 4, valve member 95 prevents any fluid flow in low-pressure fluid line 73.

In FIG. 4 it will become obvious from the relative positions of actuating rings 100 and 101 that during about 75% of the upward motion, valve member 95 remains stationary due to its fluidtight, friction fit in valve casing 82. This means that essentially all of the high-pressure fluid remains within expander 11 making possible the required constant volume heat removal as fluid is transferred from chamber 41 to chamber 42 through the regenerator. Only after a major part of the transference of fluid from warm chamber 41 to cold chamber 42 has been completed does actuating ring 101 engage valve member 95 and control its motion (FIG. 5). Finally, as both displacer and piston approach TDC, the upward motion of valve member 95 effects the closing off of line 72 below valve 74 and opens low-pressure line 73 below valve 75, causing valve 75 to open to allow the initially cooled fluid in chamber 42 to expand and further cool and provide refrigeration to an external load through heat station 37. As it expands it flows back through the regenerator and into the compression chamber, cooling the regenerator for the next cycle. Completion of expansion and exhaustion from the displacer effects the closing of valve 75 to bring the cycle back to the starting condition already explained with reference to FIG. 1.

Since the valve member 95 remains in its given position (FIG. 1 or FIG. 4) until it is actuated by actuating ring 100 or 101, and since such actuation does not occur until shaft 21 has moved through about 75% of its upward or downward stroke, it follows that the actuation of valve member 95 commences about 45° before the displacer reverses its direction of movement.

Thus, through the use of the fluid flow control means in the fluid flow lines between the compressor and expander it is possible in the apparatus of this invention to efficiently carry out the steps of the Stirling cycle. The apparatus requires but a single crank, presents the minimum sealing problems and achieves accurate, coordinated control of the piston and the displacer.

What is claimed is:

1. A cryogenic apparatus for delivering refrigeration to an external load, comprising in combination:

(a) compressor means having a rotary-driven reciprocating piston;

(b) expander means having displacer means capable of reciprocating motion to define within said expander means a warm fluid chamber and a cold fluid chamber, said chambers being of variable complementary volumes;

(c) thermal storage means providing fluid communication between said fluid chambers;

(d) driving means mechanically linking said piston and said displacer means to move them in phase along a common axis;

(e) fluid flow passage means connecting said compressor means and said expander means; and (f) fluid flow control means associated with said fluid flow passage means and arranged so as to (1) cut off fluid flow from said compressor means to said expander means throughout a major part of the compression stroke of said compressor;

(2) permit flow of high-pressure fluid from said compressor means to said warm fluid chamber during the completion of said compression stroke;

(3) cut off fluid flow from said expander means to said compressor means throughout a major part of the transference of fluid from said warm chamber to said cold chamber through said regenerator; and (4) then permit flow of fluid from said expander means to said compressor means expanding said fluid and developing refrigeration within said cold fluid chamber.

2. A cryogenic apparatus in accordance with claim 1 wherein said thermal storage means is located within said displacer means.

3. A cryogenic apparatus in accordance with claim 1 wherein said fluid flow passage means comprise a high-pressure fluid line incorporating high-pressure check valve means, low-pressure fluid line incorporating low-pressure check valve means, and variable-pressure fluid lines providing through said fluid flow control means controllable fluid communication between said high-pressure and low-pressure lines and said expander means.

4. A cryogenic apparatus in accordance with claim 3 wherein said fluid flow passage means includes heat transfer means interposed between said high-pressure and low-pressure fluid lines and said compressor.

5. A cryogenic apparatus in accordance with claim 3 wherein said driving means comprise a single shaft.

6. A cryogenic apparatus in accordance with claim 5 wherein said shaft has affixed thereto spaced annular actuating rings and said fluid flow controls means comprise:

(a) a valve body with an internal bore and having first, second and third spaced apart annular grooves in the wall defining said bore;

(b) a valve casing lining said wall of said bore coaxial with said shaft and having first, second and third sets of a plurality of radial fluid passages communicating with said first, second and third annular grooves, respectively;

(c) a valve member slidable within said valve casing under the force of said actuating rings and comprising:

(1) a sleeve encircling said shaft and spaced therefrom; and (2) two spaced apart rings affixed to said sleeve, making sliding contact with said valve casing and defining therebetween an annular fluid manifold, the length of which is chosen such that it provides fluid communication either exclusively between said first and second annular grooves through said first and second radial passages or exclusively between said second and third annular grooves through said second and third radial passages;

and wherein said low-pressure fluid line communicates with said first annular groove; said high-pressure fluid line communicates with said third annular groove and said variable pressure lines communicate with said second annular groove.

7. A cryogenic apparatus in accordance with claim 6 wherein at least a portion of said high-pressure, low-pressure and variable-pressure fluid lines are within said valve body.

8. A cryogenic apparatus in accordance with claim 7 wherein said high-pressure and low-pressure check valve means are within said valve body.

9. A cryogenic apparatus in accordance with claim 8 including expander support means and compressor support means to maintain them in positions relative to each other and wherein said valve body is mounted on said expander support means.

10. A cryogenic apparatus in accordance with claim 1 wherein said fluid flow control means cuts off fluid flow from said compressor means to said expander means throughout about 75% of said compression stroke; and cuts off fluid flow from said expander means to said compressor means throughout about 75% of said transference of said fluid from said warm chamber to said cold chamber.

11. A cryogenic apparatus for delivering refrigeration to an external load, comprising in combination:

(a) compressor means having a reciprocating piston;

(b) expander means having displacer means capable of reciprocating motion to define within said expander means a relatively warm fluid chamber and a relatively cold fluid chamber, said chambers being of variable complementary volumes;

(c) thermal storage means providing fluid communication between said fluid chambers;

(d) driving means mechanically linking said piston and said displacer means to move them in phase along a common axis;

(e) fluid flow passage means connecting said compressor means and said expander means; and (f) fluid flow control means associated with said fluid flow passage means and arranged so as to (1) cut off fluid flow from said compressor means to said expander means throughout a major part of the compression stroke of said compressor;

(2) permit flow of high-pressure fluid from said compressor means to said relatively warm fluid chamber during the completion of said compression stroke;

(3) cut off fluid flow from said expander means to said compressor means throughout a major part of the transference of fluid from said relatively warm chamber to said relatively cold chamber through said regenerator; and (4) then permit flow of fluid from said expander means to said compressor means expanding said fluid and developing refrigeration within said relatively cold fluid chamber.

* * * * *